US009097493B2

(12) United States Patent
Parida et al.

(10) Patent No.: US 9,097,493 B2
(45) **Date of Patent: *Aug. 4, 2015**

(54) BLAST/IMPACT MITIGATION SHIELD

(75) Inventors: Basant K. Parida, Bellingham, MA (US); Norman Dana, Albion, RI (US); Abdullatif K. Zaouk, Jamaica Plain, MA (US); Xudong Xin, Medford, MA (US)

(73) Assignee: Foster-Miller, Inc., Waltham, MA (US)

( * ) Notice: Subject to any disclaimer, the term of this patent is extended or adjusted under 35 U.S.C. 154(b) by 359 days.

This patent is subject to a terminal disclaimer.

(21) Appl. No.: 13/604,019

(22) Filed: Sep. 5, 2012

(65) Prior Publication Data

US 2014/0310938 A1 Oct. 23, 2014

Related U.S. Application Data

(63) Continuation of application No. 13/507,051, filed on May 31, 2012.

(51) Int. Cl.

| | |
|---|---|
| ***F41H 7/00*** | (2006.01) |
| ***F41H 5/04*** | (2006.01) |
| ***F41H 7/04*** | (2006.01) |
| ***F42D 5/045*** | (2006.01) |

(52) U.S. Cl.

CPC ..... *F41H 5/04* (2013.01); *F41H 5/0442* (2013.01); *F41H 5/0457* (2013.01); *F41H 7/042* (2013.01); *F42D 5/045* (2013.01); *Y10T 29/49826* (2015.01)

(58) Field of Classification Search

CPC ..... F41H 7/00; F41H 7/042; F41H 5/0442; F41H 5/0457; F41H 5/04; F42D 5/045; Y10T 29/49826

USPC ..... 296/187.07, 187.08; 89/36.02, 36.07, 89/918

See application file for complete search history.

(56) References Cited

U.S. PATENT DOCUMENTS

| | | | |
|---|---|---|---|
| 2,997,325 | A | 8/1961 | Peterson |
| 3,006,484 | A | 10/1961 | Pringiers |
| 3,053,526 | A | 9/1962 | Kendall |
| 3,139,290 | A | 6/1964 | Swick |
| 3,209,864 | A | 10/1965 | Boyd |
| 3,365,189 | A | 1/1968 | Carlson |

(Continued)

FOREIGN PATENT DOCUMENTS

| | | | |
|---|---|---|---|
| DE | 10 2009 029 814 | | 1/2011 |
| JP | 60252832 | A | 12/1985 |

(Continued)

OTHER PUBLICATIONS

U.S. Appl. No. 13/507,051, Parida et al.

(Continued)

*Primary Examiner* — Joseph D Pape

(74) *Attorney, Agent, or Firm* — Iandiorio Teska & Coleman, LLP

(57) ABSTRACT

A method of manufacturing a shield by fabricating a plunger plate to include outwardly extending blades on one surface thereof and coupling the plunger plate to a body of damping material with blades of the plunger plate adjacent the body of damping material. The damping material is configured to transition from a solid to a non-flowing viscous fluid state locally near the blades of the plunger plate as they are driven into the body.

26 Claims, 15 Drawing Sheets

(56) References Cited

U.S. PATENT DOCUMENTS

| | | | |
|---|---|---|---|
| 3,659,835 | A | 5/1972 | Peterson |
| 3,713,641 | A | 1/1973 | Kendall |
| 3,741,560 | A | 6/1973 | Schaller |
| 3,747,915 | A | 7/1973 | Hall |
| 3,773,187 | A | 11/1973 | Carlson |
| 3,847,252 | A | 11/1974 | Casciola |
| 3,876,044 | A | 4/1975 | Kendall et al. |
| 3,913,707 | A | 10/1975 | Wastenson et al. |
| 4,040,523 | A | 8/1977 | Carle et al. |
| 4,403,012 | A | 9/1983 | Harpell et al. |
| 4,778,633 | A | 10/1988 | Kiang et al. |
| 5,349,893 | A | 9/1994 | Dunn |
| 5,354,605 | A | 10/1994 | Lin et al. |
| 5,875,875 | A | 3/1999 | Knotts |
| 6,050,211 | A | 4/2000 | Yamaguchi |
| 6,135,252 | A | 10/2000 | Knotts |
| 6,393,999 | B1 | 5/2002 | Schneider |
| 6,477,934 | B1 | 11/2002 | Bruhn et al. |
| 6,532,857 | B1 | 3/2003 | Shih et al. |
| 6,807,891 | B2 | 10/2004 | Fisher |
| 7,255,034 | B2 | 8/2007 | Strassgurtl et al. |
| 7,806,038 | B2 | 10/2010 | Duke |
| 7,845,266 | B2 | 12/2010 | Duke et al. |
| 7,908,959 | B2 | 3/2011 | Pavon |
| 7,987,762 | B2 | 8/2011 | Joynt et al. |
| 7,997,181 | B1 | 8/2011 | Tunis et al. |
| 7,997,182 | B1 | 8/2011 | Cox |
| 8,033,208 | B2 | 10/2011 | Joynt et al. |
| 8,146,477 | B2 | 4/2012 | Joynt |
| 8,418,597 | B2 | 4/2013 | Pavon |
| 2004/0206591 | A1 | 10/2004 | Smelser |
| 2006/0013977 | A1 | 1/2006 | Duke et al. |
| 2007/0144337 | A1 | 6/2007 | Zhang et al. |
| 2008/0090933 | A1 | 4/2008 | Muratoglu et al. |
| 2008/0111396 | A1 | 5/2008 | Barbe et al. |
| 2009/0065462 | A1 | 3/2009 | Gansweidt |
| 2010/0170386 | A1 * | 7/2010 | Bhatnagar et al. ..... 89/36.02 |
| 2010/0173117 | A1 | 7/2010 | Duke et al. |
| 2010/0307327 | A1 | 12/2010 | Gettle |
| 2010/0307329 | A1 | 12/2010 | Kaswen et al. |
| 2011/0114427 | A1 | 5/2011 | Parida et al. |
| 2011/0148147 | A1 | 6/2011 | Tunis et al. |
| 2011/0169240 | A1 | 7/2011 | Schreiner et al. |
| 2011/0259185 | A1 | 10/2011 | Berning et al. |
| 2012/0055324 | A1 | 3/2012 | Pepka |
| 2012/0152098 | A1 | 6/2012 | Howland et al. |
| 2012/0186436 | A1 | 7/2012 | Parida et al. |
| 2012/0204711 | A1 | 8/2012 | Engleman et al. |
| 2013/0152774 | A1 | 6/2013 | Gonzalez |
| 2013/0319215 | A1 | 12/2013 | Panda et al. |

FOREIGN PATENT DOCUMENTS

| | | |
|---|---|---|
| JP | 2007231241 | 9/2007 |
| WO | WO 2011/059471 A1 | 5/2011 |

OTHER PUBLICATIONS

U.S. Appl. No. 13/596,472, filed Aug. 28, 2012, Hoadley et al.

U.S. Appl. No. 13/604,248, Parida et al.

U.S. Appl. No. 13/604,288, Parida et al.

Written Opinion of the International Searching Authority, International Application No. PCT/US2010/002793, mailed Dec. 30, 2010 (five(5) pages).

Jauffres et al., "Microstructural origin of physical and mechanical properties of ultra high molecular weight polyethylene processed by high velocity compaction", Elsevier Ltd. Polymer 48, (2007), pp. 6374-6383.

Written Opinion of the International Searching Authority for PCT Application No. PCT/US2012/058420 mailed Jul. 1, 2013 (five (5) pages).

Written Opinion of the International Searching Authority for PCT Application No. PCT/US2013/57814 mailed May 2, 2014 (four (4) pages).

Written Opinion of the International Searching Authority for PCT Application No. PCT/US2013/57821 mailed May 2, 2014 (seven (7) pages).

Written Opinion of the International Searching Authority for PCT Application No. PCT/US2013/57816 mailed Nov. 15, 2013 (nine (9) pages).

* cited by examiner

BLAST/IMPACT MITIGATION SHIELD

RELATED APPLICATIONS

This application is a continuation in part application of patent application Ser. No. 13/507,051.

This application is also related to U.S. patent application Ser. No. 12/925,354 filed Oct. 19, 2010 which claims the benefit of and priority to U.S. Provisional Application Ser. No. 61/281,314 filed Nov. 16, 2009 under 35 U.S.C. §§119, 120, 363, 365, and 37 C.F.R. §1.55 and §1.78 each of which is incorporated herein by this reference. This application is also related to U.S. patent application Ser. No. 13/385,486 filed Feb. 22, 2012, and incorporated herein by this reference.

FIELD OF THE INVENTION

The subject invention relates to vehicle underbody blast effects and ballistic damage mitigation.

BACKGROUND OF THE INVENTION

Mines and improvised explosive devices (IEDs) can damage vehicles and injure or kill vehicle occupants. Some work has been carried out to detect and disable mines and IEDs. Other engineering concerns tailoring vehicles to be more resistant to the blast of a mine or IED. Examples include the V-hull of the MRAP and STRYKER vehicles designed to deflect away a part of the explosive forces originating below the vehicle. See for example, published U.S. Patent Application Nos. 2011/0169240 and 2011/0148147, incorporated herein by this reference.

There is a limit, though, to how much of the explosive blast can be deflected. And, some vehicles cannot be engineered to include a V-hull. Still other vehicles cannot be equipped with heavy armor. The military HMMWV vehicle, for example, is and must remain configured to quickly traverse difficult terrain.

SUMMARY OF THE INVENTION

In examples of this invention, a lightweight effective blast shield is designed for use as a vehicle (e.g., underbody) design or as an attachment kit for blast mitigation due to a land mine or IED explosion. The shield is designed to partially deflect away the pressure wave of a blast and/or absorb a significant part of the blast energy by use of mechanisms and a phase changing material. Structures herein may be used to absorb impulses, energy, and/or blasts may be protected in the same way.

The invention features a method of manufacturing a shield by fabricating a plunger plate to include outwardly extending blades on one surface thereof and coupling the plunger plate to a body of damping material with the blades of the plunger plate adjacent the body of damping material. The damping material is configured to transition from a solid to a viscous fluid state locally near the blades of the plunger plate as they are driven into the body. The plunger plate may be formed as a truncated-V shape or a V-shape. The body can be sandwiched between a hull plate and the plunger plate. The hull plate may further include blades extending outwardly from the adjacent body. The hull plate can also be formed as a truncated-V shape or a V-shape.

One method includes stiffening the hull plate and/or plunger plate, adding damping material on top of the hull plate, and/or forming the body in sections and/or plies. The body and plunger plate can be disposed to extend over only a portion of an undercarriage of a vehicle but can could also extend over a majority of the undercarriage of the vehicle. The plunger plate can be side mounted to a vehicle. The body can be formed to include grooves receiving the blade of the plunger plate therein. There can also be grooves on the other surface of the body. The body can be sandwiched between a hull plate and the plunger plate. The hull plate may further includes blades extending outwardly therefrom adjacent the body. The body grooves receiving the blades of the plunger plate therein are preferably offset from the grooves receiving the blades of the hull plate therein.

One preferred shield is made of a damping material e.g., an ultra high molecular weight polyethylene with an acceptable specific heat of fusion greater than 120 J/g to greater than 190 J/g and a molecular weight preferably greater than 3.5 million.

The shield further may further include a second body also made of damping material in a solid state which transitions to a viscous fluid state when stressed. The plunger plate may be disposed between the bodies. In another design, a second plate is adjacent a vehicle hull and the body is between the plunger plate and the second plate. The second plate can be configured as a plunger plate.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
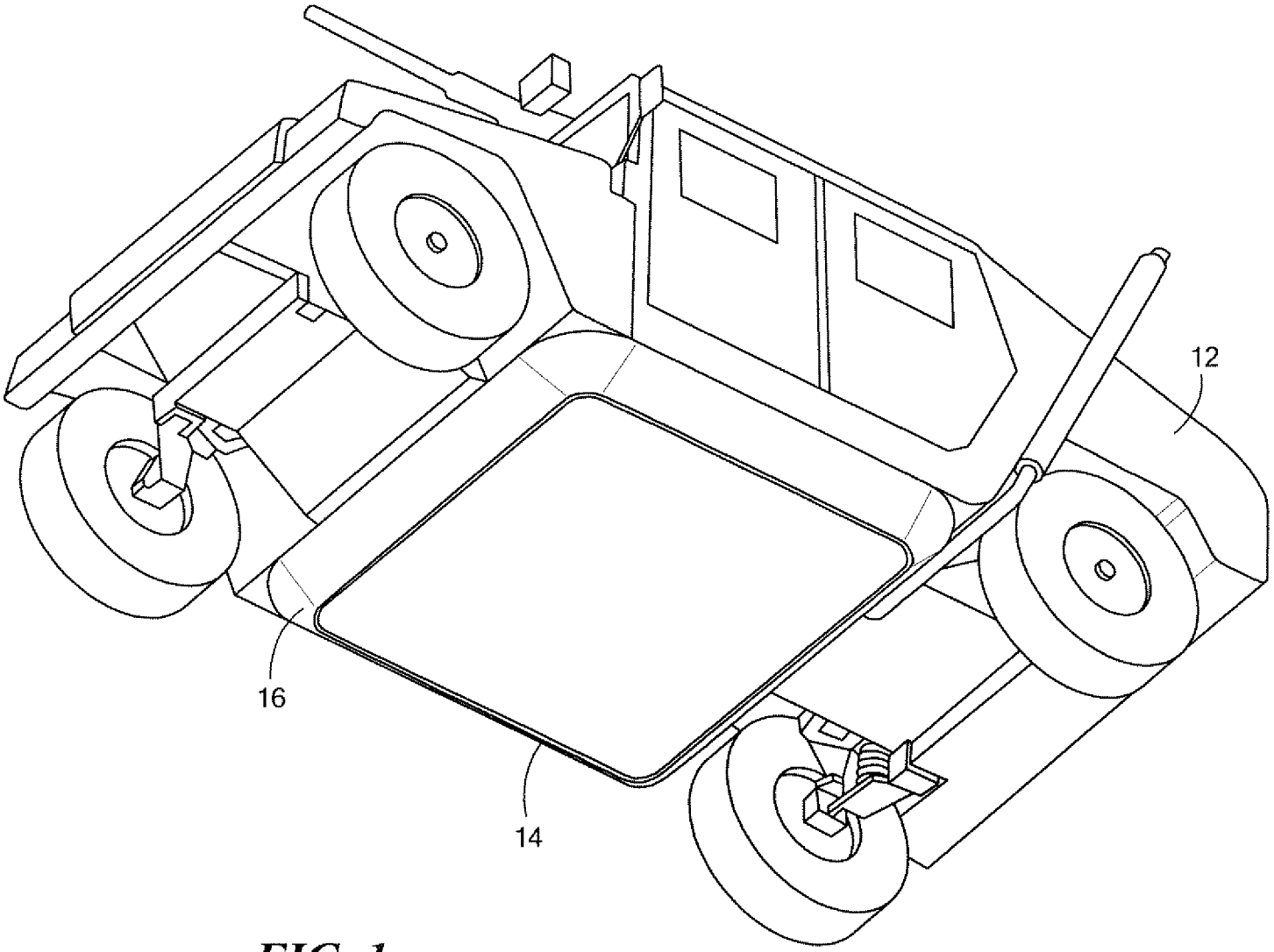
FIG. 1 is a schematic three dimensional view showing the undercarriage of a military vehicle equipped or fitted with a blast shield in accordance with an example of the invention.

Aside from the preferred embodiment or embodiments disclosed below, this invention is capable of other embodiments and of being practiced or being carried out various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
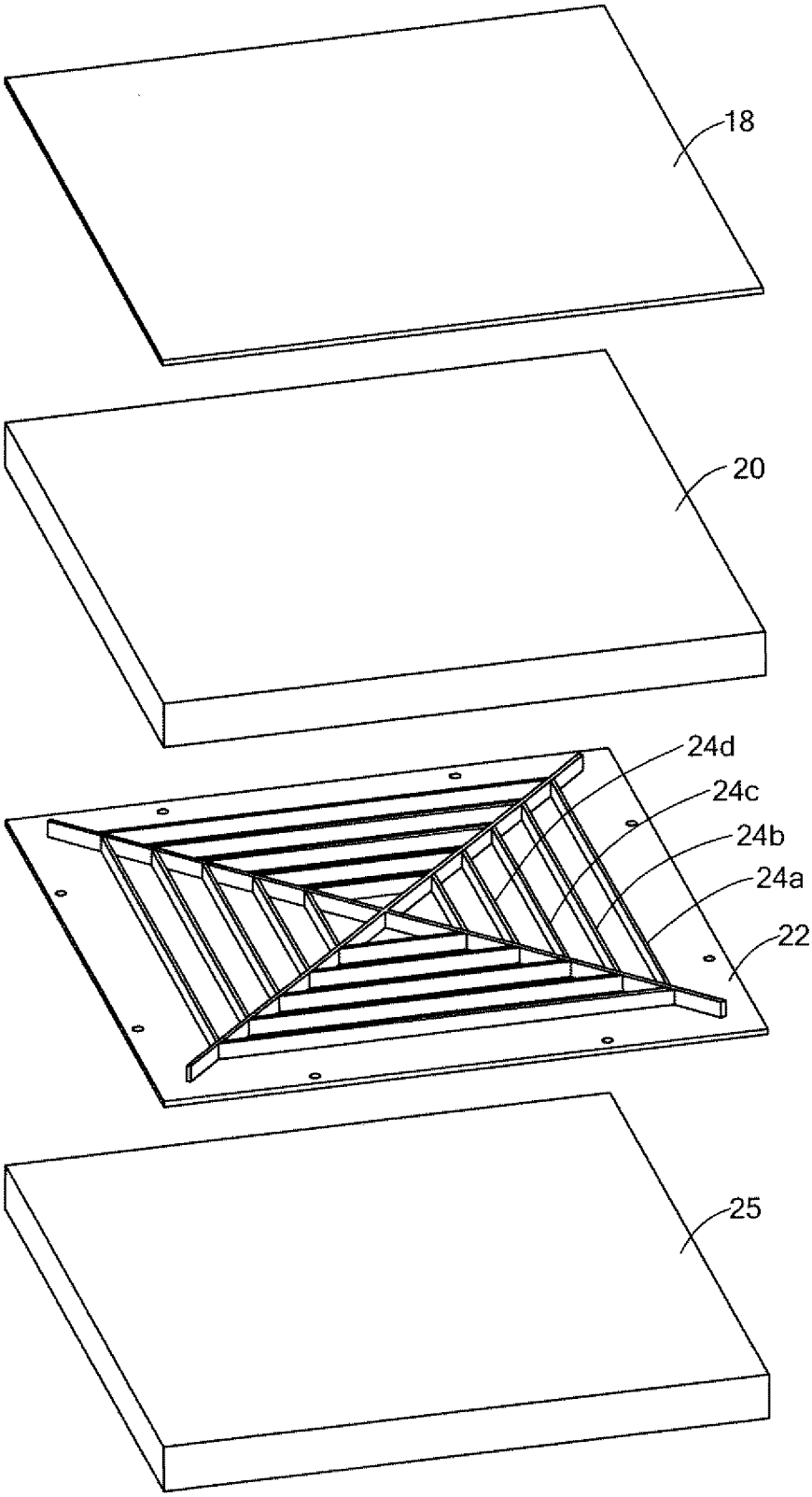
FIG. 2 is a schematic exploded front view showing the primary components associated with one example of a blast shield of the invention.

FIG. 1 shows military vehicle 12 equipped with shield 14 including, in this particular example, frame 16 bolted to the undercarriage "hull" of the vehicle. FIG. 2 shows one version (without the frame) where vehicle hull or a hull plate is depicted at 18. First body 20 abuts hull 18 and here is a slab of ultra high molecular weight polyethylene (UHMW-PE) material which transitions from a solid state to a viscous fluid state when sufficiently stressed. First body 20 could, in other embodiments, include plies of UHMW-PE material and/or be divided into sections. A plunger plate 22 may be provided and is preferably made of metal with concentric blades 24*a*-24*d* abutting the bottom surface of slab 20 in this design. The concentric blades 24*a*-24*d* may be configured in square, rectangular, circular, and elliptic or any other geometric pattern on the plunger plate 22. The blades could be adjacent: e.g., touching or closely spaced to slab 20 or even partially within body 20. Other extruded sections may also be used. See also FIG. 5. Second body 25, FIGS. 2-3 may be also included, in this example, abutting the bottom of plate 22. Body 25 may be a one to three inch thick slab of UHMW-PE material which transitions from a solid state to a viscous fluid state when stressed. Or, body 25 could be a metal plate or a so-called "hard plate". Such a kit could include blast shield hull plate 18 to replace an existing factory installed hull plate or the various layer(s) could be fastened to the existing vehicle hull plate.

When vehicle 12, FIG. 1 equipped with such an undercarriage shield drives over a mine or IED which explodes, body 25, FIG. 2 primarily functions to absorb energy from the blast caused by soil impacting the body which in response transitions from a solid state to a viscous fluid state. The UHMW-PE material will blister, crack, and shred and become heavily embedded with soil.

The combination of plunger plate 22 and body 20 functions to absorb the blast energy as the blades 24 are driven into body 20 and it changes from a solid to a viscous fluid state locally near the blades in response due to the pressure of the blast. Plate 22 may deform slightly and the blades of plate 22 will embed in body 20 and cut or partially cut into body 20.

Figure 3:
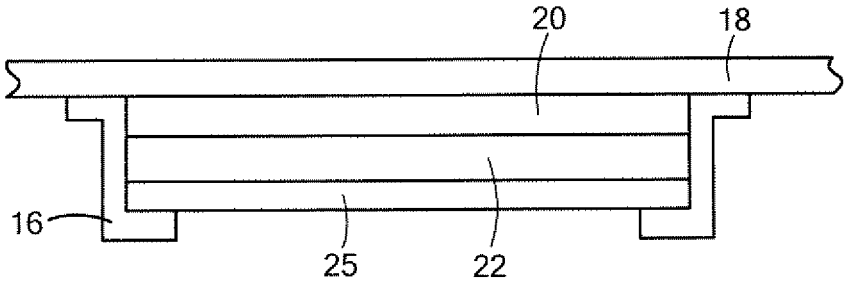
FIG. 3 is a schematic cross sectional view of the shield of FIG. 1 positioned under a vehicle hull using a frame in accordance with examples of the invention.

FIG. 3 shows the completed assembly of all components shown in FIG. 2. When a critical stress magnitude is reached, the UHMW-PE material in bodies 20 and 25 undergoes a phase transition from a solid to a viscous fluid state. This phase transition occurs at or above a critical compressive stress magnitude. Upon impact, plunger blades 24*a*-24*d* penetrate into UHMW-PE slab 20. With an increasing impact force magnitude, the UHMW-PE material undergoes a phase transition at or above the critical stress. As the UHMW-PE material ahead of and adjacent to the plunger blades transitions into a viscous fluid state, the resisting force on the plunger blades drops sharply to a lower value. The plunger blades then continue to move through the material with a gradual further rise in force magnitude until a significant amount of the impact energy is absorbed.

Considering the complete assembly of the blast/impact mitigation shield fitted to the underbody of a vehicle, schematically shown in FIG. 3, the physics of the blast effects mitigation my be explained as follows.

When a land-mine or and IED buried at certain depth in soil is detonated under a vehicle, first the mass of soil above the mine or IED strikes the bottom surface of the UHMW-PE body 25 with extremely high velocity. This extremely high momentum of soil is almost immediately reduced to a much smaller magnitude as the soil mass impinges on the UHMW-PE body 25. The resulting normal force is of such high magnitude that in all areas of soil impingements the critical stress required for phase transition of UHMW-PE is crossed. The soil mass gets embedded into the phase transitioned viscous material of the UHMW-PE body and in this process a part of the blast energy is absorbed by the body 25. The ejected soil and the blast pressure, whose magnitude depends on the explosive charge mass contained within the mine/IED and also the standoff, applies an extremely high impact force on the base of plunger plate 22, which then forces most of the plunger blades to penetrate into the UHMW-PE body 20. The resulting stress magnitudes in the UHMW-PE material in front of and surrounding the blades exceed the critical compressive stress magnitude for phase transition of UHMW-PE material. The blades of plunger plate 22 therefore penetrate into the locally transformed viscous material of UHMW-PE body 20, which is supported against the application of normal force by the hull or the armor plate 18 of the vehicle. The work done in this process of plunger plate 22 displacement against the resistance offered to penetration of blades by the UHMW-PE body 20 is quite significant and this accounts for a large amount of blast energy absorption/dissipation. The remaining blast energy would cause the vehicle to be thrown up in the air. The height of throw depends on the remaining energy available following significant amount of energy absorbed by the blast/impact mitigation shield.

The blast/impact mitigation shield therefore reduces the net vertical upward force experienced by the vehicle and its occupants. This results in relatively lower magnitude of vertical acceleration, which can be designed to remain within a certain tolerance level for a specific threat of blast impulse.

The reduction in upward vertical acceleration of a vehicle fitted with a blast/impact mitigation shield following an underbody mine/TED blast can also be explained considering the rate of change of momentum. While a vehicle with only an armor plate used as underbody hull experiences a huge change in momentum within an extremely short time interval, the same vehicle, if fitted with a blast/impact mitigation shield, will take considerably longer time interval for the change of momentum due to the work done by the plunger plate 22 on the UHMW-PE body 20. The force magnitude being proportional to the rate of change of momentum will be smaller for the latter case and so also the magnitude of vertical acceleration.

The preferred phase change material has an extremely high heat of fusion (145-195 J/g), and thus it requires a significant amount of energy to transition it from a solid to a non-flowing viscous liquid state. In so doing, a significant amount of impact energy is dissipated. A material exhibiting a heat of fusion of greater than 190 J/g and a molecular weight of greater than 3.5 million is preferred. But, a heat of fusion greater than about 120 Joules per gram (J/g) may be acceptable. The percent crystallinity should preferably be greater than 10.

The molecular weight, specific heat of fusion and percent crystallinity of the UHMW-PE material stated above are preferred values. However, other polymer materials such as high density polyethylene (HDPE) and other polyethylene exhibiting similar phase transition behavior above a certain critical compression stress, but having smaller values of the above physical parameters can be used for this application.

Figure 4:
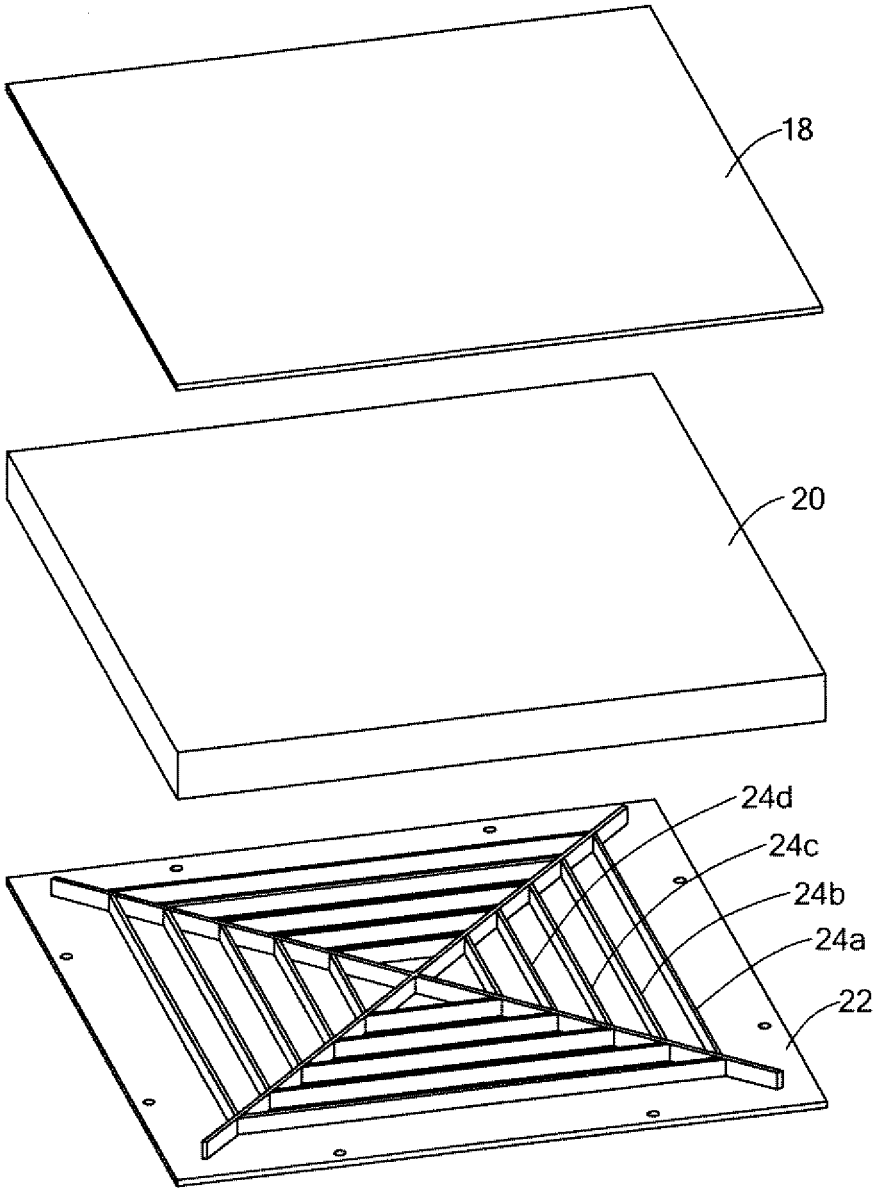
FIG. 4 is a schematic exploded three dimensional front view showing another example of a blast shield in accordance with the invention.
Figure 5:
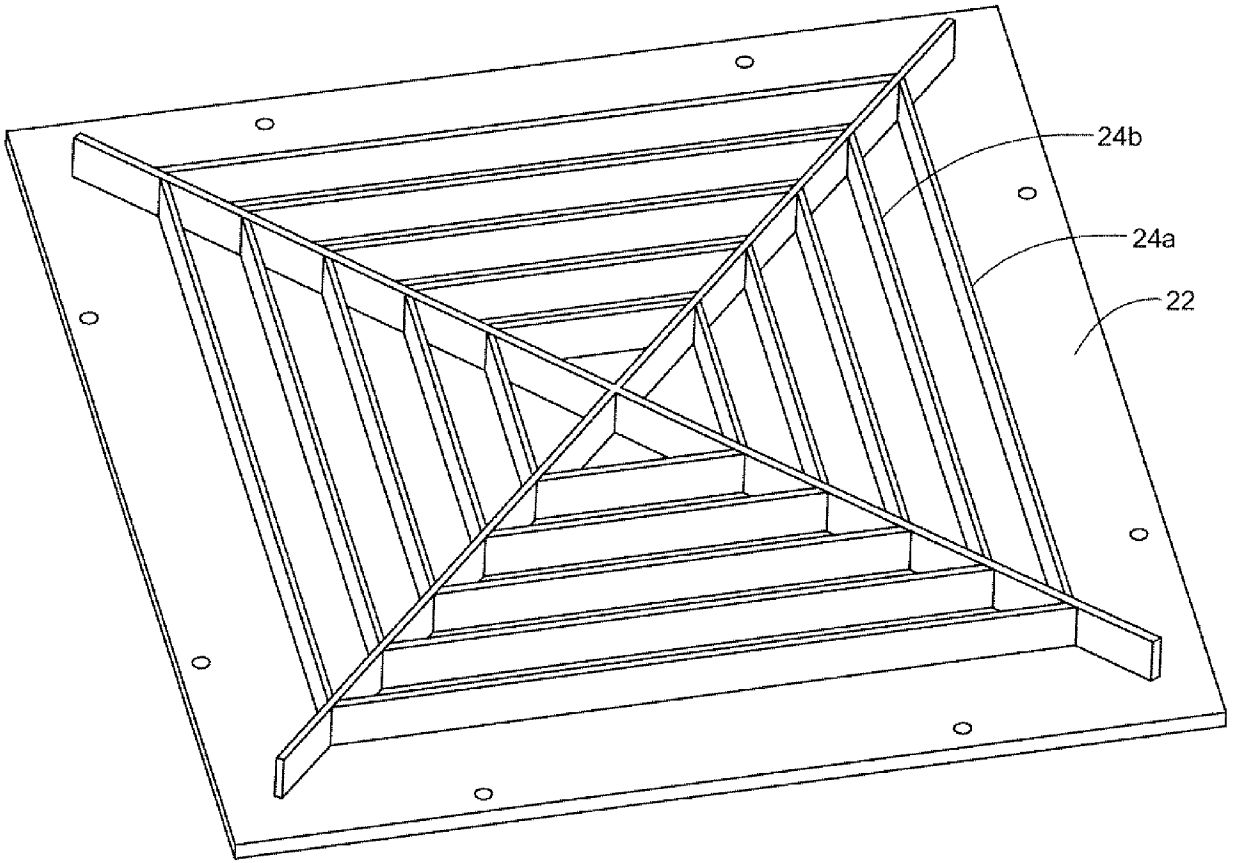
FIG. 5 is a schematic three dimensional top view showing a plunger plate in accordance with examples of the invention.

In the example of FIG. 4, second body 25 of FIG. 2 is not used. Instead, plate 22 abuts body 20 and body 20 abuts the hull or an armor plate under the vehicle 18. Again, a frame may be used. In one test of this configuration, conducted using a blast test fixture weighing 17,500 pounds, three one inch thick plies of UHMW-PE material were placed between a one-quarter inch simulated hull plate 18 and plunger plate 22 as shown in FIG. 5. 7.27 lbs. of composition C4 explosive 8" in diameter and 2¼" tall in a 24" diameter cylinder was buried with 4" of soil (50% sand, 50% clay, 12% moisture content). The standoff between plate 22 and the soil was 15.25 inches.

Upon detonation of the C4 explosive, blades 24*a*-24*d* cut thorough the first layer of body 20 but only partially embedded in the second layer of body 20. The third layer was unaffected. One-half inch thick metal plunger plate 22 was permanently deformed 1.3" and hull 18 was deformed 2.9".

Figure 6:
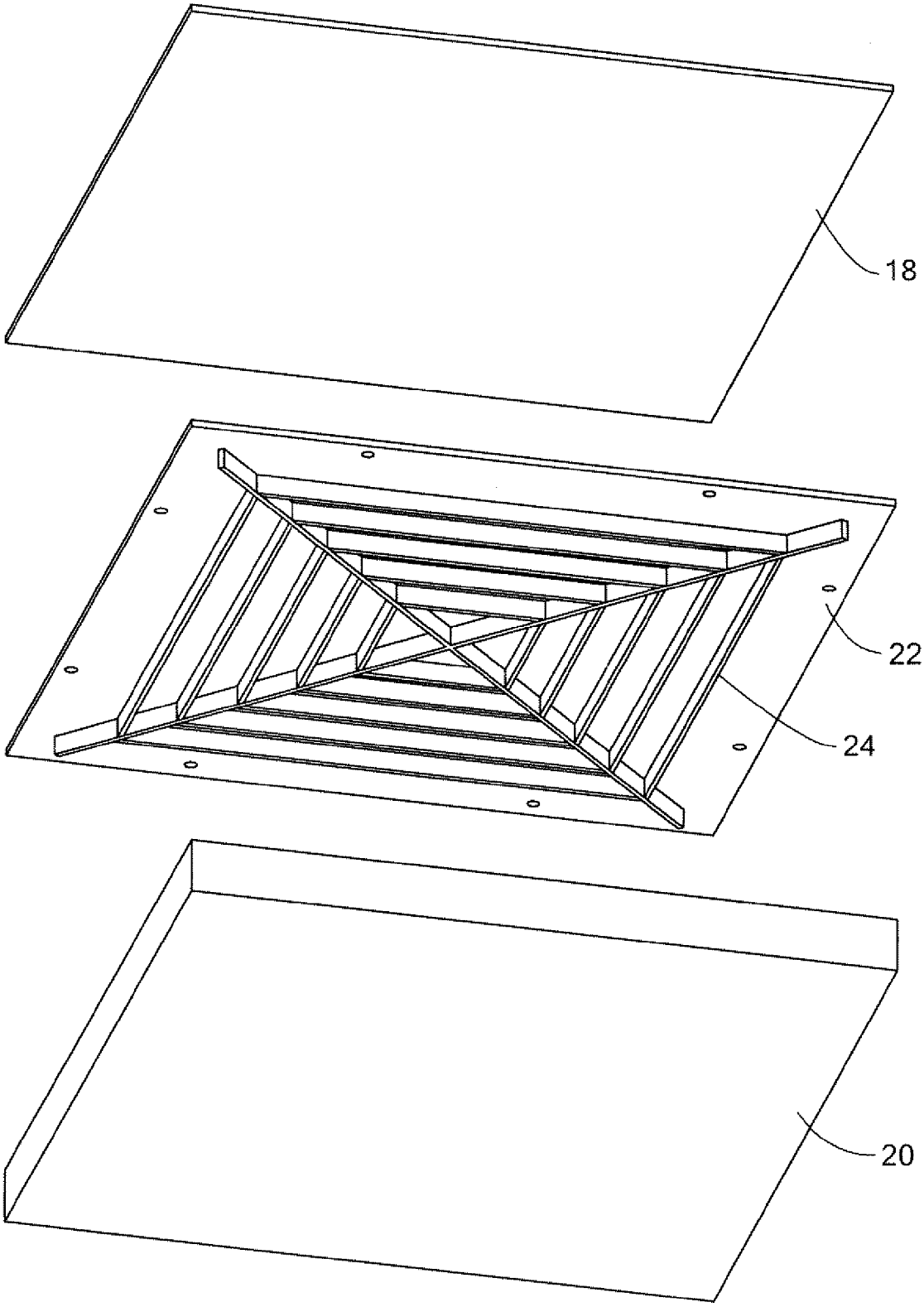
FIG. 6 is a schematic exploded three dimensional view showing another example of a blast shield in accordance with the invention.

FIG. 6 shows an option where plunger plate 22 abuts hull 18 and blades of plate 22 face the top of UHMW-PE body 20. Another stiff plate may be used below the UHMW-PE body 20 (not shown in FIG. 6).

In still another example, under carriage shield 14, FIG. 1 is one or more plies and/or one or more sections of UHMW-PE or similar material without a plunger plate. Frame 16 is also optional.

Six 1" layers were bolted to a ¾" thick rolled homogeneous armor (RHA) steel test "hull" and tested as in the example above. At a 9.25" standoff, the hull plate was permanently deformed by 2⅞". The bottom most layer of UHMW-PE material was blistered, cracked, and shredded (heavily soil embedded). The second layer of UHMW-PE material was only marginally affected and was intact, somewhat discolored since it was somewhat exposed to this soil blast. The third through sixth layers of UHMW-PE material were unaffected. With a 15.25" standoff using four layers of 1" thick UHMW-PE material, the hull plate deformed by 4". The lowest most UHMW-PE layer was intact but imbedded with soil. The second through fourth layers were unaffected.

Examples of the invention provide a new type of blast or impact energy absorption that utilize a novel design and unique elastic-plastic deformation behavior of ultra high molecular weight (UHMW) polyethylene or similar materials. They unexpectedly exhibit rapid absorption of kinetic energy and reduce blast force magnitude through an energy absorption process and in causing slight delay in the rate of change of momentum during an impact or blast event. The UHMW-PE material undergoes a reverse phase transition back to solid state when the stress level drops below the critical value following the impact or blast event. It dissipates the absorbed energy by way of expansion through solidification and also in doing work by partially pushing back the plunger or plunger blades. See also U.S. application Ser. No. 13/385,486 file Feb. 22, 2012 incorporated herein by this reference.

Featured is a blast mitigation shield comprising damping material in a solid state and which transitions from a solid to a viscous fluid state when stressed in compression above a critical stress, for example due to a blast event. A plunger plate includes blades positioned in or adjacent to the damping material to be driven into the damping material when impacted by a blast event transitioning the damping material to a viscous fluid state absorbing the impact. In other examples, the system described herein is configured as a drop platform. The "hull" described herein is thus the primary surface of the drop platform.

Blast or impact shields in accordance with the examples of the invention include one or more bodies of damping material in a solid state and which transition from a solid to a viscous fluid state when stressed in compression. Examples of the material include ultra high molecular weight polyethylene, high density polyethylene (HDPE), and equivalents thereof. A constraining frame is optional. If used, the plunger plate may include extended blades which may terminate in pointed knife portions positioned at or closely adjacent to the damping material. When the plunger plate is impacted by a blast event or an impact event, the blades are driven into the damping material transitioning it locally near the blades from a solid to a viscous fluid state absorbing the energy of the blast or the impact through work done by the plunger blades. For an airdrop platform, the damping material and/or plunger blades may be secured to the bottom of a drop platform, and/or distributed as narrow strips along the perimeter of the bottom surface.

Figure 7:
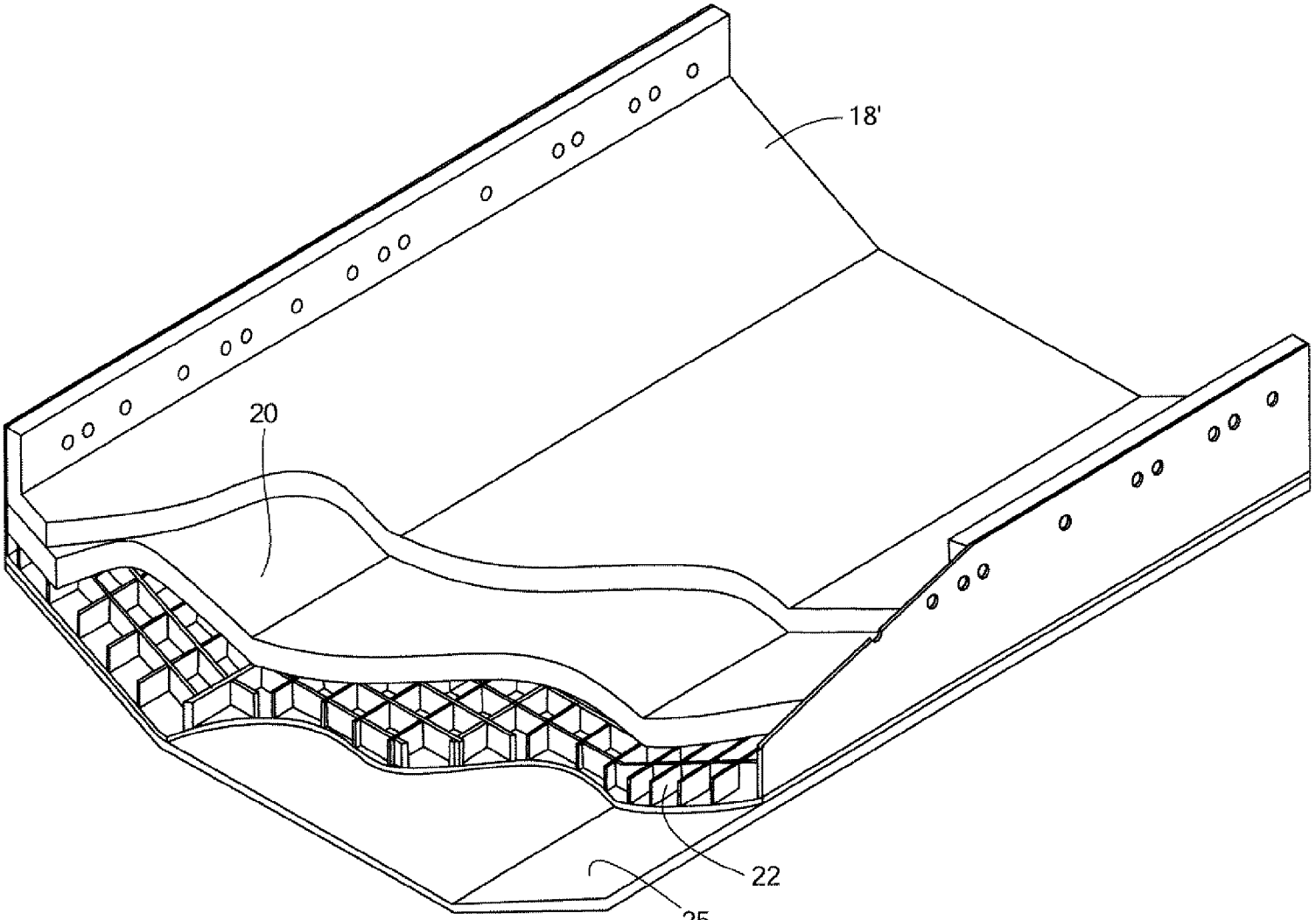
FIGS. 7-8 are schematic views of truncated V-hull blast shields.
Figure 8:
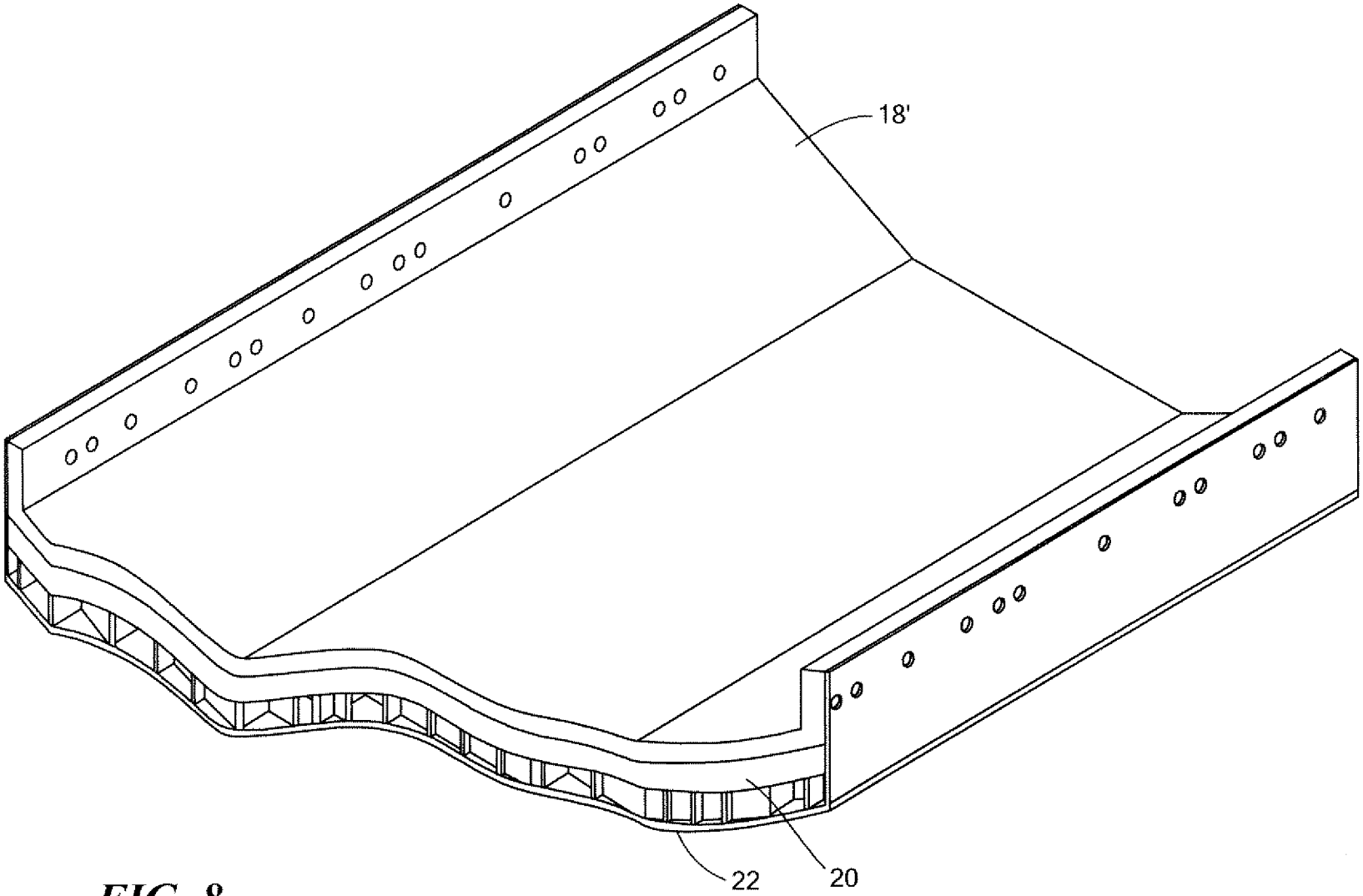

The blast/impact mitigation shield can be designed for a vehicle having flat bottom hull as schematically shown in FIG. 1 and also for a vehicle having a "V-shaped" hull or a "double V-shaped hull". FIGS. 7 and 8 schematically show examples of a vehicle underbody truncated V-hull 18' and corresponding truncated V-shaped blast/impact mitigation shield design. The blast/impact mitigation shield can be designed and configured to meet the same objective of blast effect mitigation.

Figure 9:
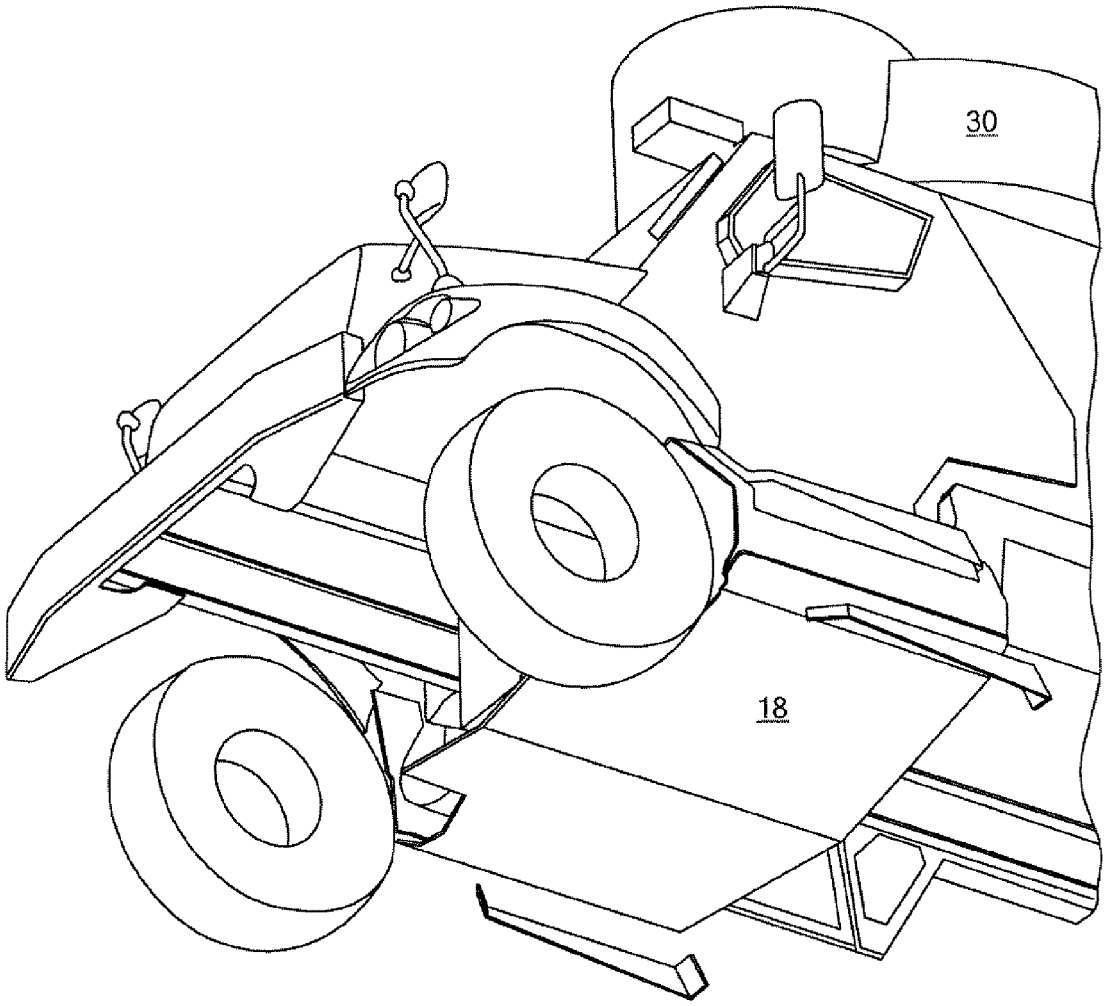
FIG. 9 is a schematic three dimensional view showing the undercarriage of a particular military vehicle.

FIG. 9 depicts a "Mine Resistant Ambush Protected" (MRAP) vehicle with existing hull plate 18. At the factory or in the field, the blast shield may be attached to hull plate 18 or, alternatively, hull plate 18 could be removed and the blast shield, typically including a replacement blast shield hull plate, could be fastened to the vehicle undercarriage in place of the factory provided hull plate. In other designs, the blast shield extends along most of the undercarriage of the vehicle. In still other designs, the blast shield is disposed inside the vehicle, on the vehicle floor or deck for example.

Figure 10:
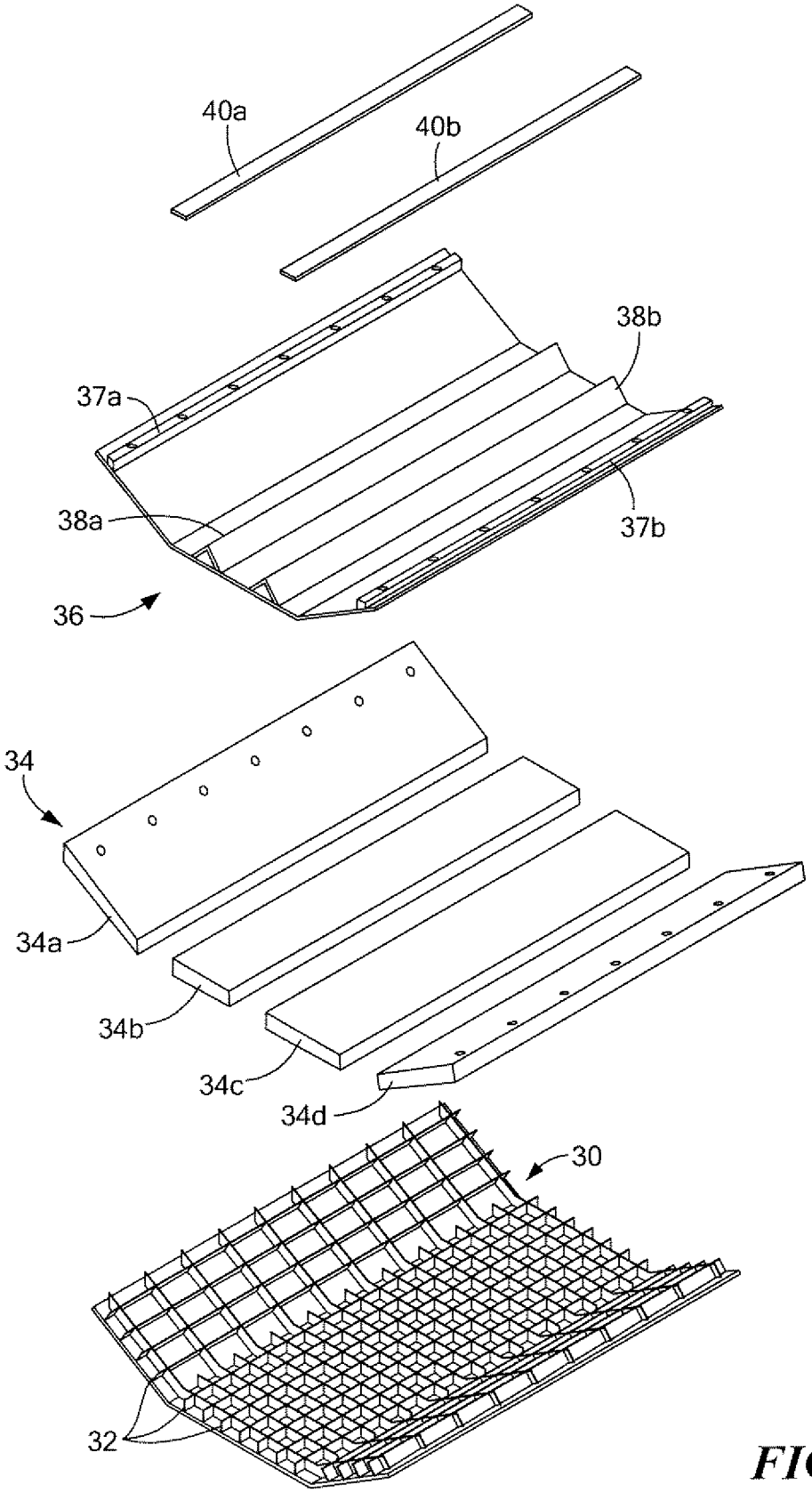
FIG. 10 is a schematic exploded view of an example of a blast shield in accordance with the invention which may be used with the vehicle shown in FIG. 9 and/or other vehicles.

FIG. 10 shows a truncated-V configured blast shield assembly including ⅜" steel plunger plate 30 with blades 32 (1½" tall and 3/16" thick). In other designs, the blades are post-like structures, pyramid shaped, for example. In this example, UHMW-PE body 34 is divided into sections 34*a*, 34*b*, 34*c* and 34*d* 1¼" to 2" thick to conform to the contours of both plunger plate 30 and hull plate 36. Each section could include multiple plies. In other examples, a monolith sheet or sheets are used and they are shaped to conform to plunger plate 30. In this particular example, hull plate 36 is also a truncated-V shaped metal plate ⅜" thick with stiffener members 38*a* and 38*b*. UHMW-PE strips 40*a* and 40*b* reside on the top of hull plate 36. Typically, fasteners are used to secure plunger plate 30 to both UHMW-PE body 34 and hull plate 36. Hull plate 36 then includes bolting rails 37*a* and 37*b* for mounting the sandwich assembly to the bottom of the vehicle or even to the existing factory installed hull plate, armor, or the like. Plunger plate 30 in this particular embodiment utilizes both longitudinal and transverse blades in the pattern shown which penetrate body section 34*a*-34*d*. The longitudinal and transverse blades also act to stiffen blast plate 30 and transfer the blast forces over a greater effective area for larger penetration of the UHMW-PE 34*a*-34*d* to maximize the absorption of energy.

In other examples, hull plate 36 and plunger plate 30 have a V-shaped, or flat, or conforming shape to fit a particular vehicle undercarriage.

Figure 11:
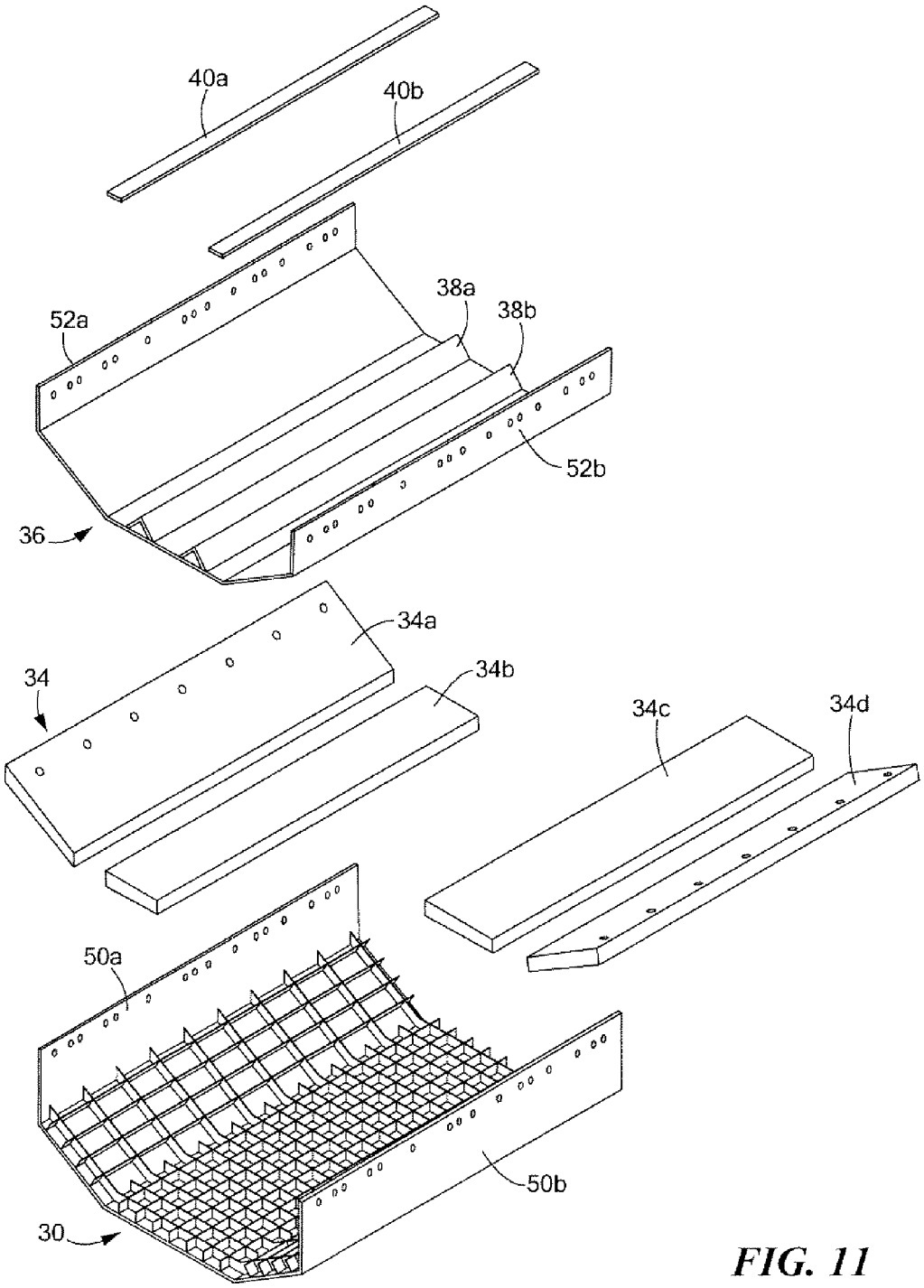
FIG. 11 is a schematic exploded view of an example of a side mount blast shield similar in construction to the blast shield of FIG. 10.

FIG. 10 shows a bottom mount configuration while FIG. 11 shows a side mount configuration where plunger plate 30 now includes side plates 50*a* and 50*b* and hull plate 36 includes corresponding side plates 52*a* and 52*b*. Hull plate side plates 52*a* and 52*b* can be fastened to the vehicle undercarriage.

Figure 12:
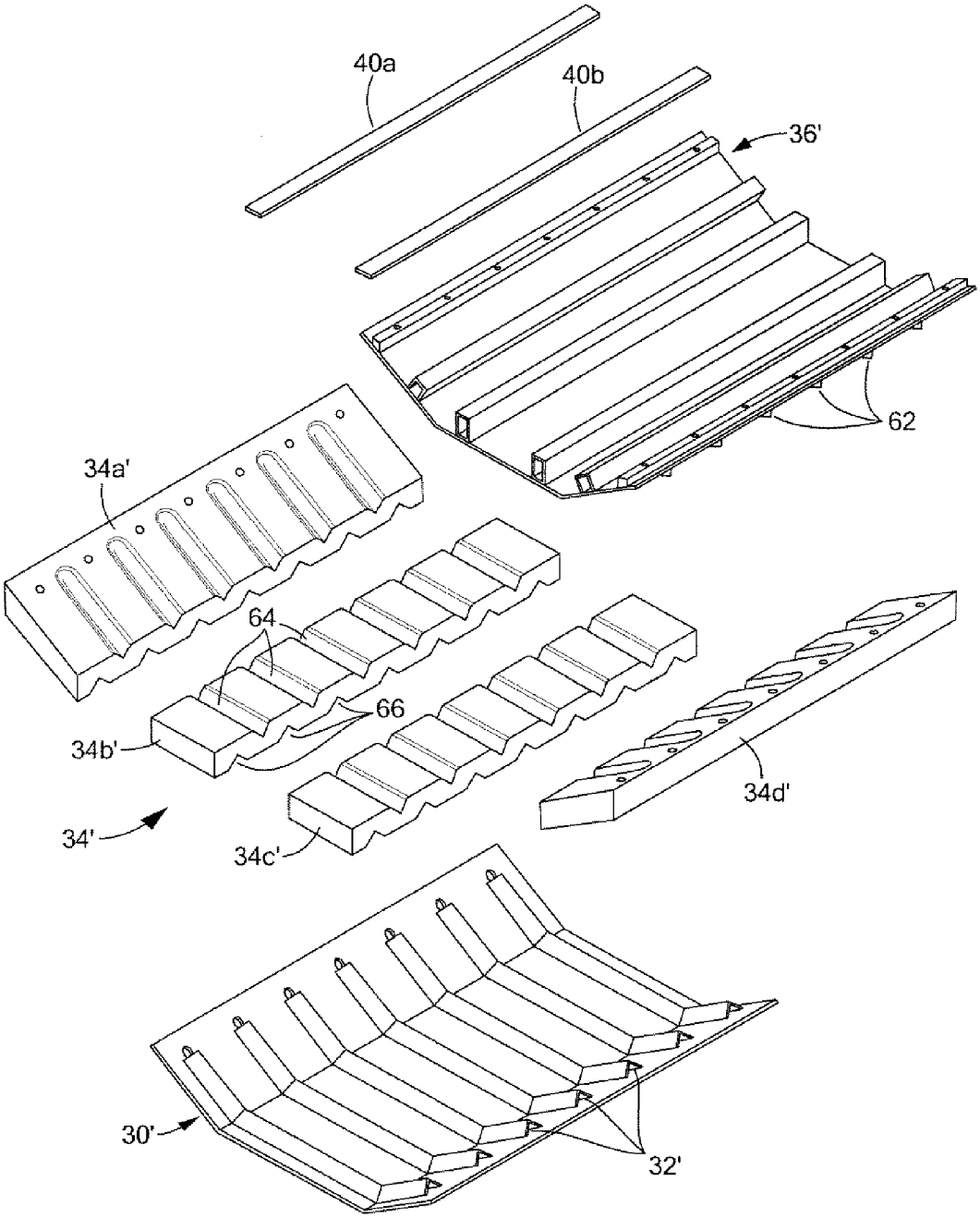
FIG. 12 is a schematic exploded view showing another configuration of a blast shield in accordance with the invention.
Figure 13:
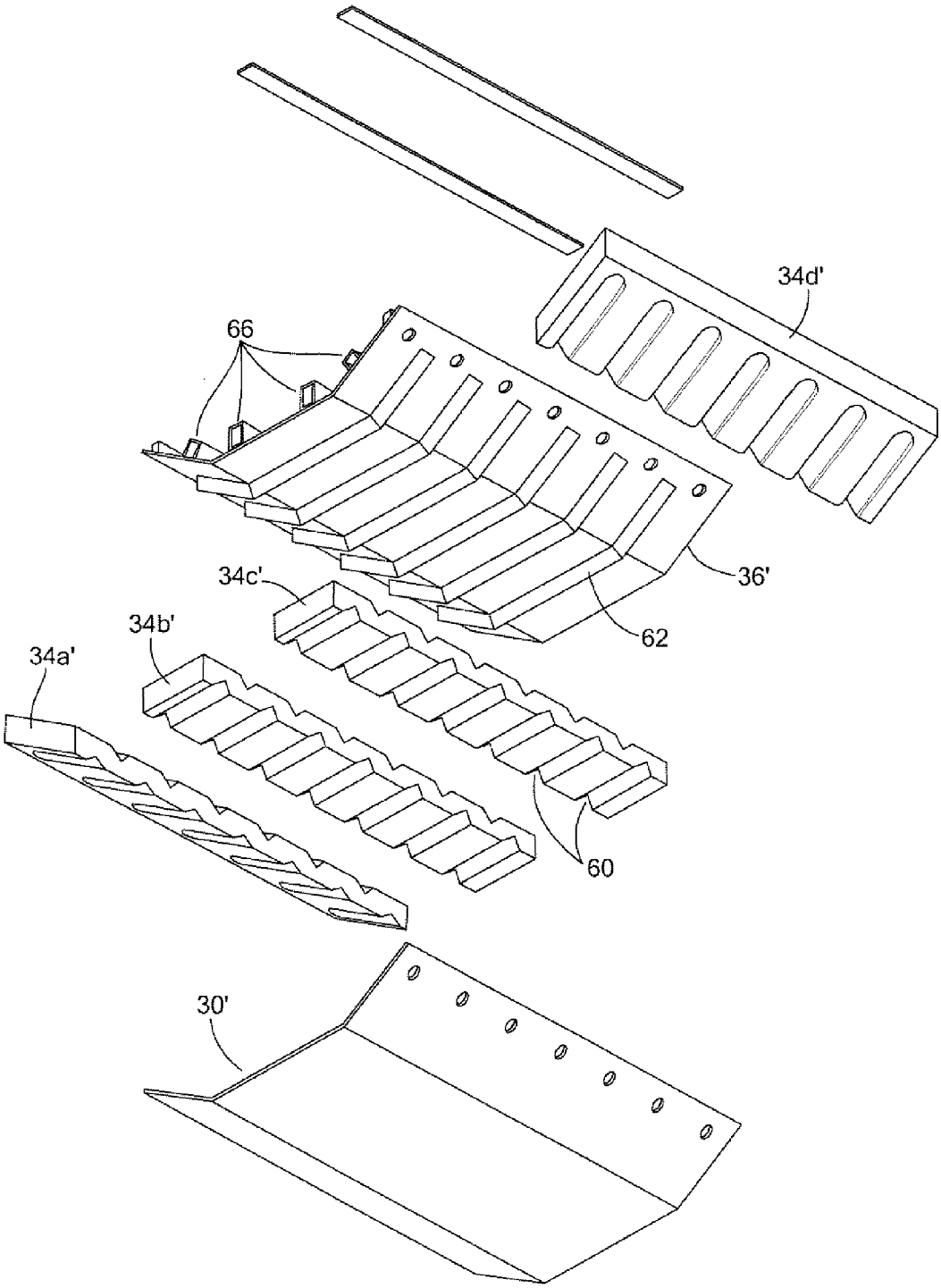
FIG. 13 is a schematic exploded view showing the underside of the blast shield hull plate of FIG. 12.

FIGS. 12-13 show a design where plunger plate blades 32' are formed of metal angle or triangle shaped members. UHMW-PE body 34' has sections 34*a'*, 34*b'*, 34*c'* and 34*d'* (3 inches thick) with grooves 60 formed in the underside thereof corresponding to blades 32' of plunger plate 30' so the blades thereof are received in the grooves of the UHMW-PE body. This design enables a thinner overall assembly with a thicker body of blast absorbing material resulting in a greater standoff between the blast shield and the ground.

Hull plate 36 may also include blades 62 on its underside (like a plunger plate) and the top of body 34' may now include grooves 64 receiving blades 62 therein. Blades 62 may also be triangular shaped steel members. Hull plate 36' may further include stiffening member 66. UHMW-PE strips 40*a* and 40*b* may also be provided as before. The grooves 64 on the top of body 34' are offset from the grooves 60 on the bottom of body 34'. As before, the angled blades 32' and 62 may penetrate and entrap the phase transitioned material of body 34' between the hull and blast plates and partly absorb the energy released by a blast.

Figure 14:
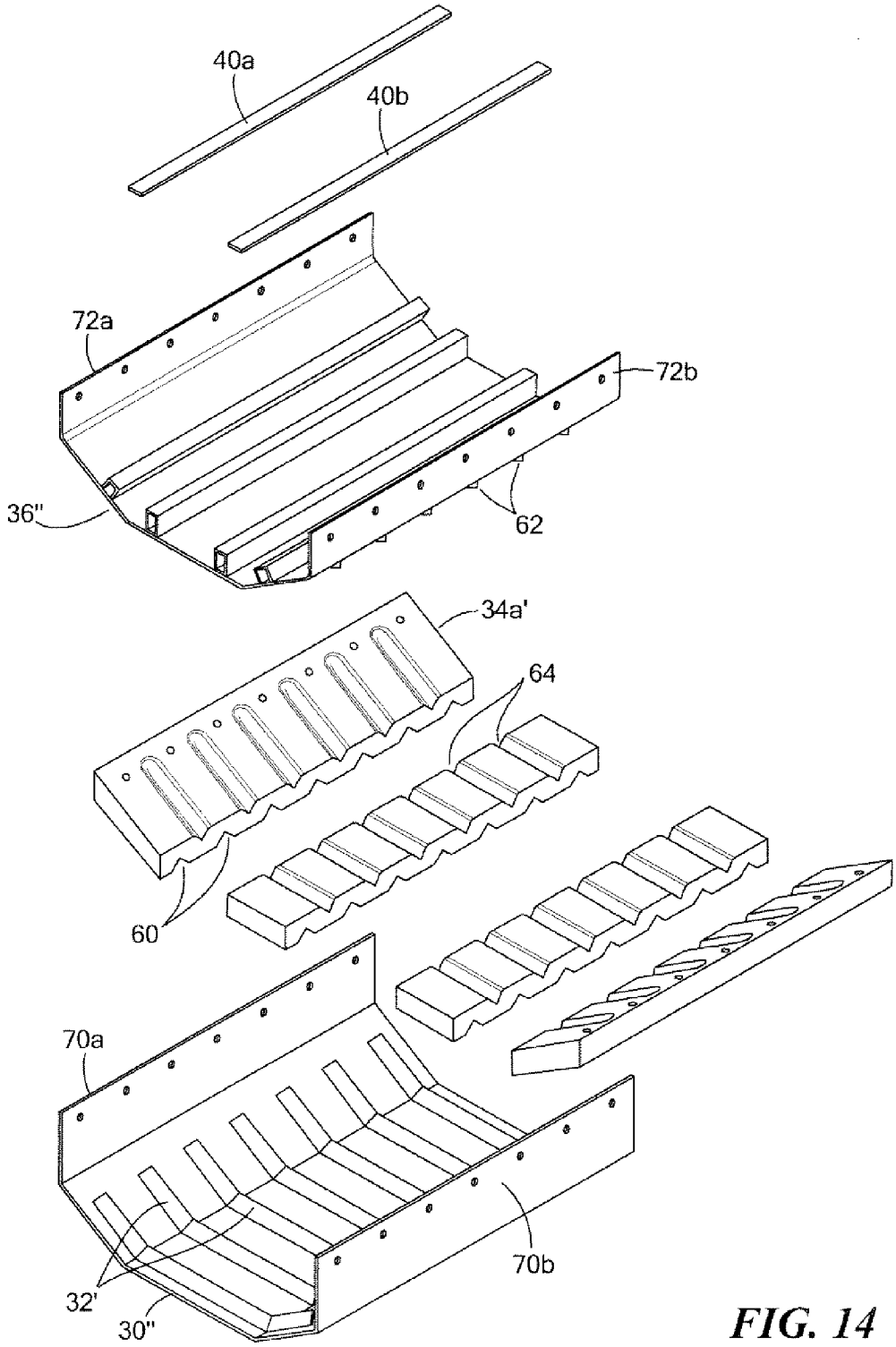
FIG. 14 is a schematic exploded view showing a side mounted version of the blast shield of FIGS. 12 and 13.
Figure 15:
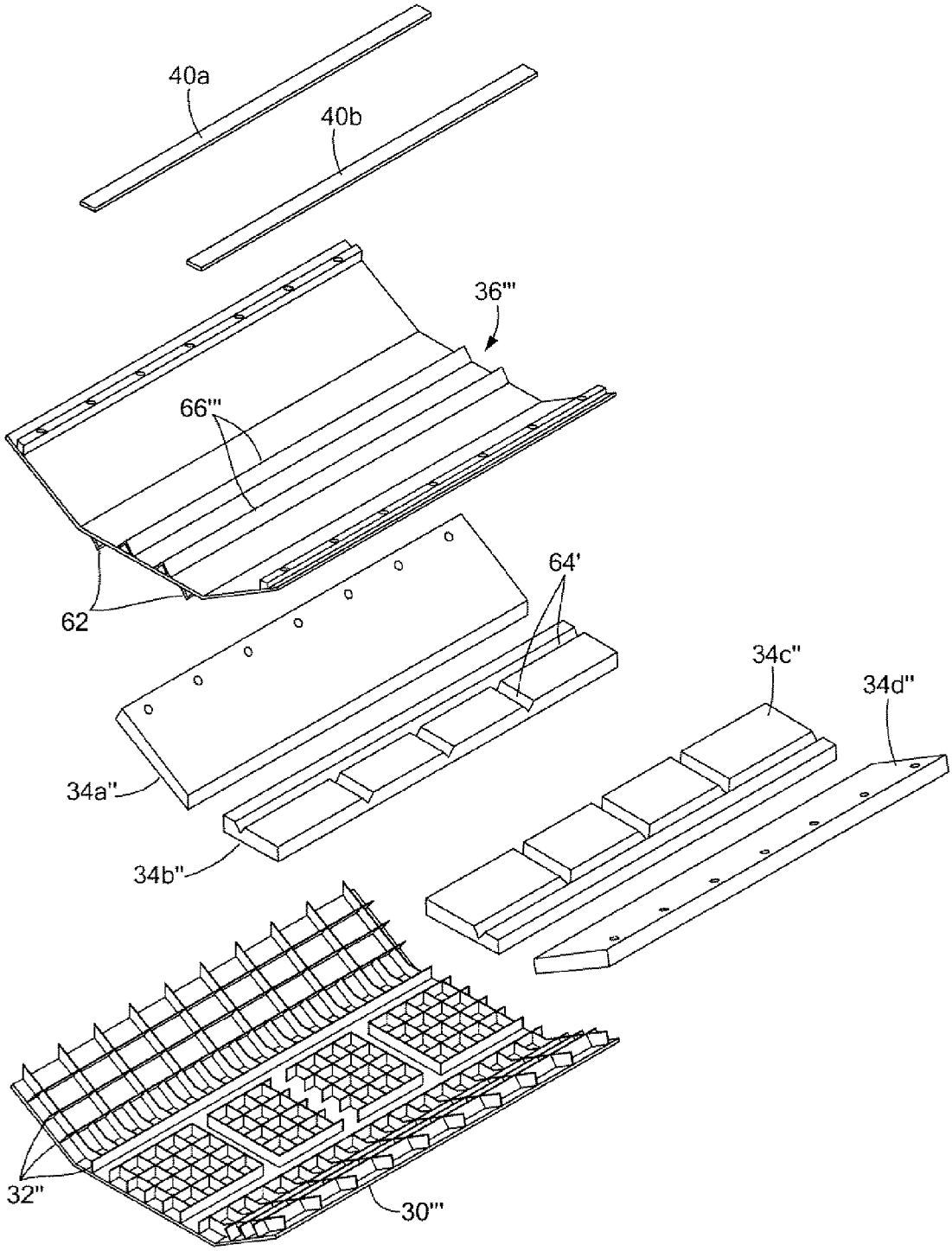
FIG. 15 is a schematic exploded view showing another example of a blast shield in accordance with the invention.
Figure 16:
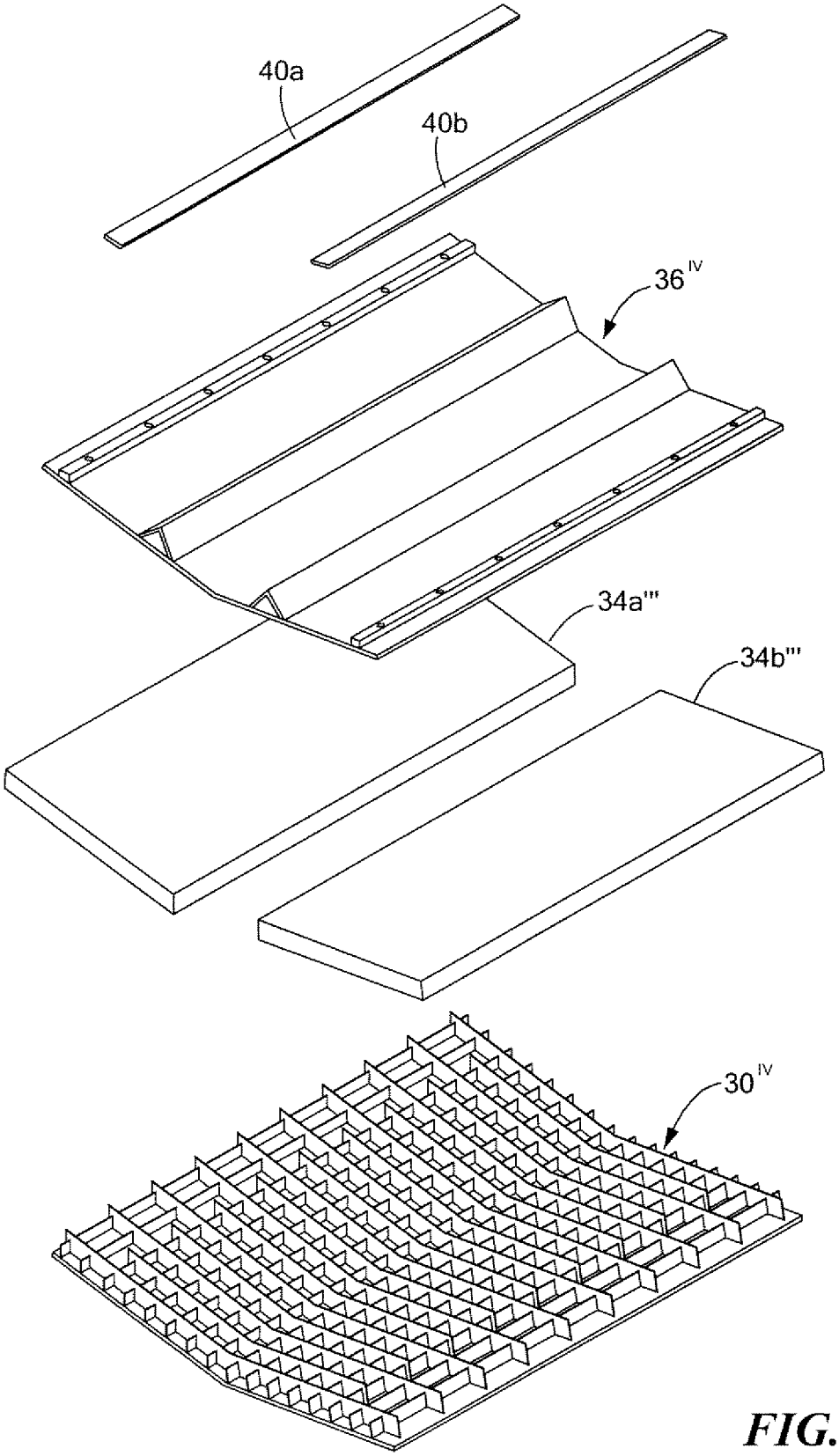
FIG. 16 is a schematic exploded view of an example of a V-hull blast shield.

FIG. 14 shows a side mount version of the design of FIGS. 12-13 wherein plunger plate 30" includes side plates 70*a* and 70*b* and hull plate 36" includes side plates 72*a* and 72*b*. In some designs, plunger plate 30" includes blades and/or hull plate 36" includes blades. Depending on the specific design, absorbing body 34' may include top and/or bottom grooves. FIG. 15 shows another possible design with plunger plate 30' having blades 32", UHMW-PE body sections 34*a"*-34*d"*, 0.25 inch hull plate 36", and strips 40*a* and 40*b*. Here, the bottom of body sections 34" may be smooth. Grooves 64' in the top surface of the body sections correspond to blades (e.g., blade 62) extending downwardly from the bottom of hull plate 36'''. It is also possible for body sections 34" to have grooves on the bottom surface thereof receiving the blades of plunger plate 30'''. A side mount version of this design is also possible. FIG. 16 shows a V-hull design with plunger plate 30$^{iv}$, body section 34*a'''* and 34*b'''*, and hull plate 38$^{iv}$.

Thus, although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A method of manufacturing a shield, the method comprising:

fabricating a plunger plate to include outwardly extending blades on one surface thereof; and coupling the plunger plate to a body of damping material with blades of the plunger plate adjacent the body of damping material, the damping material configured to transition from a solid to a non-flowing viscous fluid state locally near the blades of the plunger plate as they are driven into the body.

2. The method of claim 1 in which the plunger plate is formed as a truncated-V shape, a V-shape or a double V-shape.

3. The method of claim 1 further including sandwiching the body between a hull plate and the plunger plate.

4. The method of claim 3 in which the hull plate further includes blades extending outwardly therefrom adjacent the body.

5. The method of claim 3 in which the hull plate is formed as a truncated-V shape or a V-shape.

6. The method of claim 3 further including stiffening the hull plate and/or plunger plate.

7. The method of claim 3 further including adding damping material on top of the hull plate.

8. The method of claim 1 in which the body is formed in sections.

9. The method of claim 1 in which the body includes plies.

10. The method of claim 1 in which the body and plunger plate are configured to extend over only a portion of an undercarriage of a vehicle.

11. The method of claim 1 in which the body and the plunger plate are configured to extend over a majority of the undercarriage of a vehicle.

12. The method of claim 1 in which the plunger plate is side mounted to a vehicle.

13. The method of claim 1 in which the body is formed to include grooves receiving the blade of the plunger plate therein.

14. The method of claim 13 further including forming grooves on the other surface of the body.

15. The method of claim 14 further including sandwiching the body between a hull plate and the plunger plate.

16. The method of claim 15 in which the hull plate further includes blades sections extending outwardly therefrom adjacent the body.

17. The method of claim 16 in which the body grooves receiving the blades of the plunger plate therein are offset from the grooves receiving the blades of the hull plate therein.

18. The method of claim 1 in which the damping material is ultra high molecular weight polyethylene.

19. The method of claim 18 in which the damping material has an acceptable specific heat of fusion greater than 120 J/g.

20. The method of claim 19 in which the preferable specific heat of fusion is greater than 190 J/g.

21. The method of claim 18 in which the damping material has a molecular weight preferably greater than 3.5 million.

22. The method of claim 1 further including adding a second body including damping material in a solid state and which transitions to a non-flowing viscous fluid state when stressed.

23. The method of claim 22 in which said plunger plate is between the bodies.

24. The method of claim 1 further including adding a second plate.

25. The method of claim 24 in which said plunger plate is configured to be adjacent a vehicle hull and said body is between said plunger plate and said second plate.

26. The method of claim 25 in which said second plate is configured as a plunger plate.

* * * * *